US005445389A

United States Patent [19]

Jeffreyes, Jr.

[11] Patent Number: 5,445,389

[45] Date of Patent: Aug. 29, 1995

[54] FUTURISTIC BOARD GAME

[76] Inventor: Walter C. Jeffreyes, Jr., 2412 W. Presbury St., Baltimore, Md. 21216

[21] Appl. No.: 307,191

[22] Filed: Sep. 16, 1994

[51] Int. Cl.[6] ..... A63F 3/00

[52] U.S. Cl. ..... 273/243

[58] Field of Search ..... 273/243, 248, 249, 251

[56] References Cited

U.S. PATENT DOCUMENTS

| | | | |
|---|---|---|---|
| 3,658,338 | 4/1972 | Wheelock | 273/239 |
| 4,368,889 | 1/1983 | Reker | 273/248 X |
| 4,449,709 | 5/1984 | McKay | 273/248 |
| 4,560,170 | 12/1985 | Enyi | 173/248 |
| 4,712,673 | 12/1987 | Moore | 273/287 X |
| 5,050,888 | 9/1991 | Schultz | 273/248 |
| 5,333,877 | 8/1994 | Pridgeon | 273/248 |

FOREIGN PATENT DOCUMENTS

| | | | |
|---|---|---|---|
| 2213071 | 8/1989 | United Kingdom | 273/239 |

*Primary Examiner*—William E. Stoll ,

[57] ABSTRACT

A futuristic board game for allowing players to unite against and attempt to defeat an alien dimensional traveler comprising a story page and rule book combination with the story page providing a fictional backdrop and the rule book providing rules of play; a plurality of game pieces including hero game pieces identified as Offshoots with each hero game piece representing a player and villain game pieces including Phantom Soldier game pieces, Rasper game pieces, Hero-crusher game pieces, at least one Sinklow game piece; and at least one Starship Castle game piece; a plurality of dice; a plurality of playing cards upon which a player acts; and a game board having a plurality of situation spaces and a plurality of traveling spaces interconnected therebetween, wherein movement and actions of a hero game piece upon reaching a situation space is set forth by the rules of play within the story page and rule book combination.

1 Claim, 3 Drawing Sheets

10

FUTURISTIC BOARD GAME

BACKGROUND OF THE INVENTION

1. Field of the Invention

The present invention relates to a futuristic board game and more particularly pertains to allowing players to unite against and attempt to defeat an alien dimensional traveler with a futuristic board game.

2. Description of the Prior Art

The use of board games is known in the prior art. More specifically, board games heretofore devised and utilized for the purpose of allowing players to unite to defeat an opposing foe are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,807,740 to Allred discloses a space flight board game apparatus. U.S. Pat. No. 5,037,109 to Bowen discloses a space travel game. U.S. Pat. No. 5,064,200 to Martinez discloses a method of playing a board game. U.S. Pat. No. 5,067,720 to Bundy discloses a board game apparatus. U.S. Pat. No. 5,092,606 to Miller discloses a board game. U.S. Pat. No. 5,236,193 to Ierulli discloses a black hole board game.

While these devices fulfill their respective, particular objective and requirements, the aforementioned patents do not describe a board game that allows players to unite with each other to defeat a common foe in a futuristic setting.

In this respect, the futuristic board game according to the present invention substantially departs from the conventional concepts and designs of the prior art, and in doing so provides an apparatus primarily developed for the purpose of allowing players to unite against and attempt to defeat an alien dimensional traveler.

Therefore, it can be appreciated that there exists a continuing need for new and improved futuristic board game which can be used for allowing players to unite against and attempt to defeat an alien dimensional traveler. In this regard, the present invention substantially fulfills this need.

SUMMARY OF THE INVENTION

In the view of the foregoing disadvantages inherent in the known types of board games now present in the prior art, the present invention provides an improved futuristic board game. As such, the general purpose of the present invention, which will be described subsequently in greater detail, is to provide a new and improved futuristic board game and method which has all the advantages of the prior art and none of the disadvantages.

To attain this, the present invention essentially comprises, in combination, a story page and rule book combination with the story page providing a fictional backdrop and the rule book providing rules of play. Twenty two game pieces are provided. The game pieces include a group of five hero game pieces identified as "Offshoots" with each hero game piece in the group identified as "Changin", "Geodesic", "Hoop", "Laptop" and "Sleeper" and with each hero game piece representing a player. Villain game pieces are provided including ten "Phantom Soldier" game pieces, four "Rasper" game pieces, one "Hero-crusher" game piece, one "Sinklow" game piece, and one "Starship Castle" game piece. Five dice are included with each having a box shape with six faces and with the faces of each die bearing dotted indicia from 1 to 6 respectively. Forty-eight playing cards are provided and separated into five stacks with the first stack having thirteen "Sinklow" cards, the second stack having eleven "Question House" cards, the third stack having ten "Game Preserve" cards, the fourth stack having eight "Visit the Owl" cards, and the fifth stack having six "Junkyard/Ship" cards with the cards bearing instructions and information upon which a player acts as set forth by the rules of play within the story page and rule book combination. Lastly, an essentially rectangular and planar game board is included and has a starting space positioned at one corner representing the initiation of a journey for each player, a "Playground" situation space, a plurality of "Time Door" situation spaces, a "Game Preserve" situation space, a "Sleeper's World" situation space, a "Junkyard/Ship" situation space, a "Polluted Lake" situation space, a "City Park" situation space, a plurality of "Attack" situation spaces, a "Question House" situation space, a "Danger Door" situation space, an "Owl's Lair" situation space, a "Hero-Crusher" situation space 85, a "Starship" situation space, and a plurality of traveling spaces interconnected therebetween, wherein movement and actions of a hero game piece upon reaching a situation space is set forth by the rules of play within the story page and rule book combination.

There has thus been outlined, rather broadly, the more important features of the invention in order that the detailed description thereof that follows may be better understood, and in order that the present contribution to the art may be better appreciated.. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved futuristic board game which has all the advantages of the prior art board games and none of the disadvantages.

It is another object of the present invention to provide a new and improved futuristic board game which may be easily and efficiently manufactured and marketed.

It is a further object of the present invention to provide a new and improved futuristic board game which is of durable and reliable construction.

An even further object of the present invention is to provide a new and improved futuristic board game which is susceptible of a low cost of manufacture with regard to both materials and labor, and which accordingly is then susceptible of low prices of sale to the consuming public, thereby making such a futuristic board game economically available to the buying public.

Still yet another object of the present invention is to provide a new and improved futuristic board game which provides in the apparatuses and methods of the prior art some of the advantages thereof, while simultaneously overcoming some of the disadvantages normally associated therewith.

Even still another object of the present invention is to provide a new and improved futuristic board game for allowing players to unite against and attempt to defeat an alien dimensional traveler.

Lastly, it is an object of the present invention to provide a new and improved futuristic board game for allowing players to unite against and attempt to defeat an alien dimensional traveler comprising a story page and rule book combination with the story page providing a fictional backdrop and the rule book providing rules of play; a plurality of game pieces including hero game pieces identified as "Offshoots" with each hero game piece representing a player and villain game pieces including "Phantom Soldier" game pieces, "Rasper" game pieces, "Hero-crusher" game pieces, at least one "Sinklow" game piece; and at least one "Starship Castle" game piece; a plurality of dice; a plurality of playing cards upon which a player acts; a game board having a plurality of situation spaces and a plurality of traveling spaces interconnected therebetween, wherein movement and actions of a hero game piece upon reaching a situation space is set forth by the rules of play within the story page and rule book combination.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
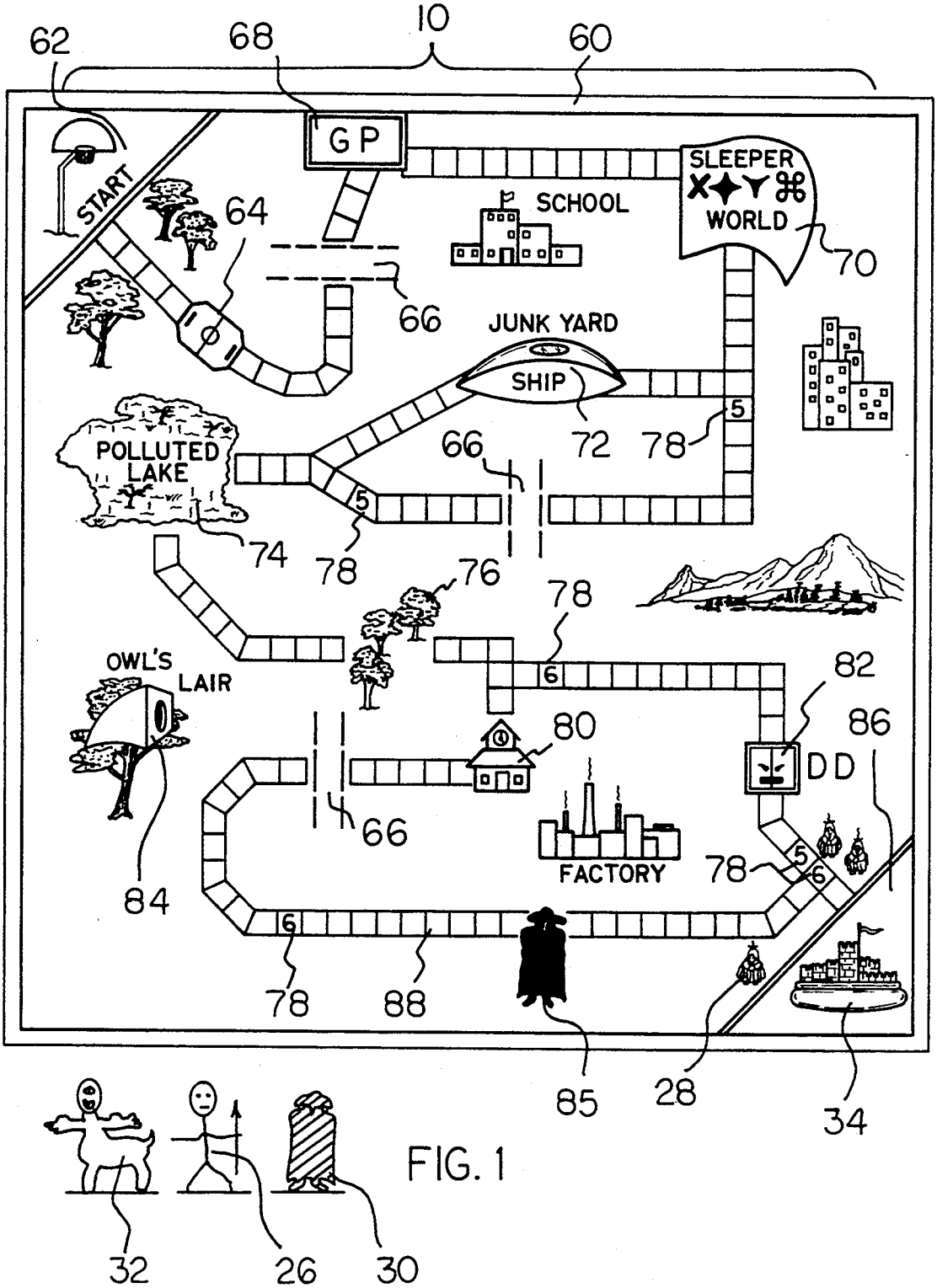
FIG. 1 is a plan view of the game board and several game pieces of the preferred embodiment of the present invention.
Figure 2:
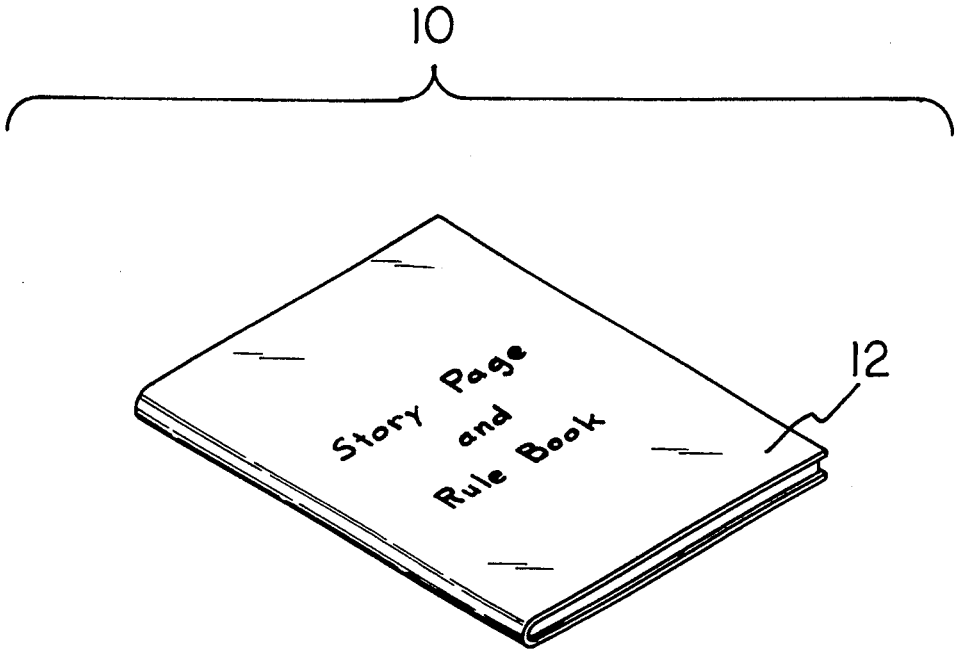
FIG. 2 is a perspective view of the story page and rule book combination of the present invention.

With reference now to the drawings, and in particular, to FIG. 1 thereof, the preferred embodiment of the new and improved futuristic board game embodying the principles and concepts of the present invention and generally designated by the reference number 10 will be described.

Specifically, the present invention essentially includes five major components. The major components are the story page and rule book combination, game pieces, dice, playing cards, and game board. These components are interrelated to provide the intended function.

More specifically, it will be noted in the various Figures that the first major component is the story page and rule book combination 12. The story page of the combination provides a fictional backdrop for playing the game. The rule book of the combination provides the rules of play.

Figure 6:
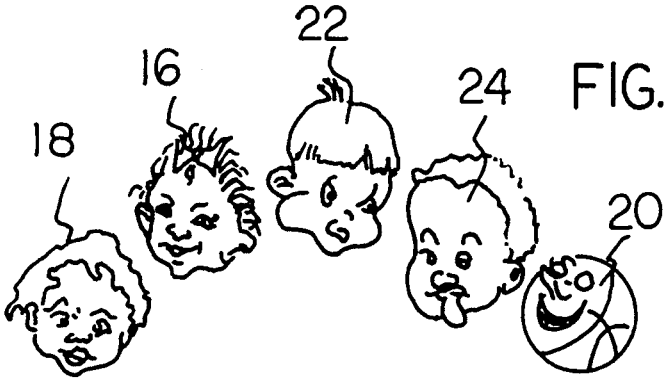
FIG. 6 depicts the "Offshoots" represented by the hero game pieces and identified from left to right, respectively, as "Geodesic", "Changin", "Laptop", "Sleeper" and "Hoop".
Figure 5:
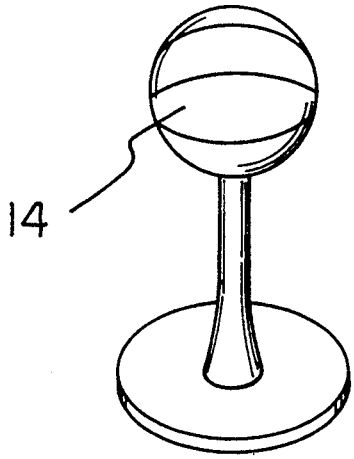
FIG. 5 is a perspective view of a game piece of the present invention identified as "Hoop".

The second major component is the game pieces 14. The present invention includes twenty-two game pieces. A group of five hero game pieces are identified as "Offshoots". Each hero game piece in the group is identified as "Changin" 16, "Geodesic" 18, "Hoop" 20, "Laptop" 22, and "Sleeper" 24 as shown in FIG. 6. Each hero game piece represents a player. Each hero game piece also has certain inherent capabilities useful in defeating the alien dimensional traveler. Villain game pieces are provided. The villain game pieces includes ten "Phantom Soldier" game pieces 26, four "Rasper" game pieces 28, one "Hero-Crusher" game piece 30, one "Sinklow" game piece 32, and one "Starship/Castle" game piece 34. The "Sinklow" game piece represents the alien dimensional traveler who the players, represented as the "Offshoots", are trying to defeat. Players must also defeat other villain game pieces who are minions to "Sinklow". Each game piece may be positioned upon a pedestal as shown in FIG. 5.

Figure 3:
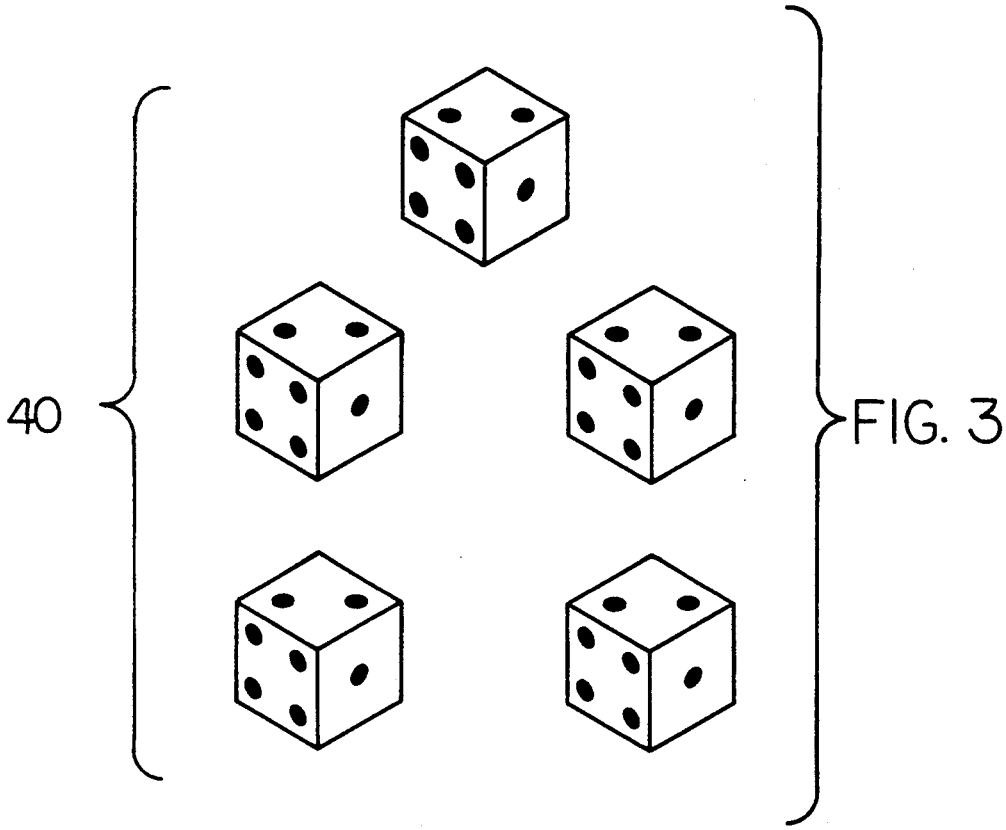
FIG. 3 is a perspective view of the dice used with the present invention.
Figure 4:
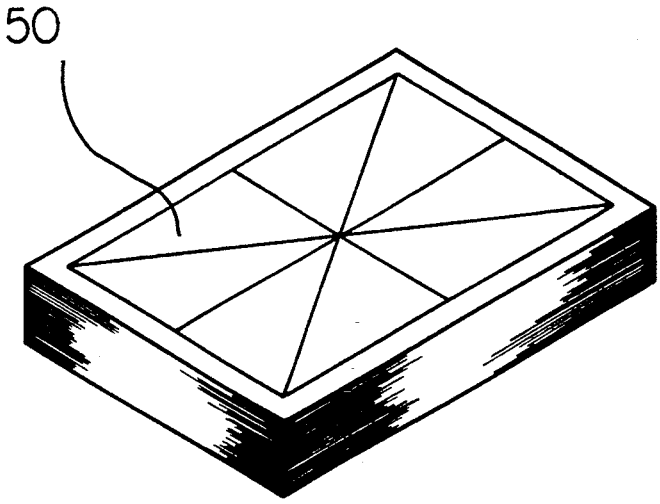
FIG. 4 is a perspective view of one of the stacks of playing cards used with the present invention.

The third major component are the dice 40. The present invention includes five dice as shown in FIG. 3. Each dice has a box shape with six faces. The faces of each die bear dotted indicia from 1 to 6 respectively. The dice control movement and actions of game pieces as set forth in the rules of play within the story page and rule book combination.

The fourth major component is the playing cards 50. The present invention includes forty-eight playing cards. The playing cards are separated into five stacks. The first stack has thirteen "Sinklow" cards, the second stack has eleven "Question House" cards, the third stack has ten "Game Preserve" cards, the fourth stack has eight "Visit the Owl" cards, the fifth stack has six "Junkyard/Ship" cards. The cards bear instructions and information upon which the player acts as set forth by the rules of play within the story page and rule book combination.

The fifth major component is the game board 60. The game board is essentially rectangular, planar, and rigid in structure. It has a starting space 62 positioned on one corner. The game board represents a futuristic city. The starting space represents the initiation of a journey for each player. The starting space bears a picture of a basketball goal. The game board also includes a "Playground" situation space 64, a plurality of "Time Door" situation spaces 66, a "Game Preserve" situation space 68, a "Sleeper's World" situation space 70, a "Junkyard/Ship" situation space 72, a "Polluted Lake" situation space 74, a "City Park" situation space 76, a plurality of "Attack" situation spaces 78, a "Question House" situation space 88, a "Danger Door" situation space 82, an "Owls's Lair" situation space 84, a Hero-Crusher situation space 85, a "Starship" situation space 86, and a plurality of traveling spaces 88 interconnected therebetween. The travelling spaces and the situation spaces in combination represent an invisible path through the city. Movement and actions of a hero game piece upon reaching a situation space is set forth by the rules of play within the story page and rule book combination.

The object of the game is to eliminate an alien dimension traveler ("Sinklow") by destroying him and his starship home (Castle of Dread) before he uses its stock of enchantments to destroy the modern city or the world. The heroes or players must unite to defeat this common foe who is not a true player.

The story page of the story page and rule book combination is set forth as follows:

I. STORY PAGE:

Five alien offspring unselfishly leave their saddened mother for fear her undernourished body would die of starvation on the overpopulated and starved tiny world of Toc'Volin. Their young but forceful minds made up, the gelatin bodied creatures journeyed through the hazardous infinite vastness of space. Their bodies, while in an infant state, were able to withstand the numbing pressure of the void as they traveled on the cosmic winds. After a long journey gaining vast but unknown power by sustaining themselves on the diverse minute life forms trapped in the space currents, earth's gravity and atmosphere attracted and reeled them into her embrace. The entities were somehow drawn to four children, each several months old who were enjoying themselves immensely while being pushed along in strollers through the city park. Each alien being entered the nostril of one child. The fifth entity, having no child about, observed a basketball rolling by the strollers, apparently from a nearby playground. The creature entered the ball through an air passage then forced itself to roll away into the safety of the nearby bushes. Kids from the playground ran past looking for the ball but soon gave up the search. The parents of the babies, unaware of what had transpired, still discussed the topic of child rearing. The babies showed no visible signs of the invasion of their bodies.

At that time . . . (and so on . . . )

The rule book of the story page and rule book combination is set forth as follows:

II. RULE BOOK:

1) All pieces move once per turn unless directed otherwise by the reading of one of the playing cards.
2) The "Offshoot" called "Hoop" must begin the game by rolling the dice (since the other heroes are pre-teens and are unable to lead, "Hoop" must make a basket shot by rolling a 4 or 5).
3) The roll of the dice by one player determines the move for all players at any one time; all players will have a chance to roll during the course of the game.
4) All heroes may occupy the same space anytime since they are allies against the dreaded "Sinklow".
5) Since "Sinklow" is a non-player, the figure can be moved by any player in the game when directed to do so.

PLAY

1) An invisible path exists through the city, only the "Offshoots", "Sinklow" and his minions can see it.
2) Play begins with the player who assumes the guise of "Hoop", a living basketball. "Hoop" must roll a 4 or 5 on the dice to move. Each miss allows "Sinklow" to move two spaces ahead. "Hoop" continues to roll until he succeeds in changing the pre-teens to teenagers.
3) Follow the directions of each obstacle or read the direction cards ("Playground", "Game preserve", etc . . . )

SITUATION SPACES

Playground

"Offshoots" must stop at basketball court on playground and play a game against new bullies in the neighborhood. Each player rolls the dice once, the combined total must equal a number between 24 and 29. Numbers under 24 and over 29 will allow "Sinklow" to move two spaces. "Offshoots" must roll until they beat the bullies, only then can they leave the playground. "Hoop" must roll a 5 or 6 during his turn. "Laptop" rolls to lead the way out.

Game Preserve

"Offshoots" must stop here and pick a card, follow the card's directions. "Changin" rolls to lead the way out.

Time Doors

"Offshoots" revert back to pre-teens when entering the Time doors, all heroes/players must roll a 3 or 4 to change back, only then can a "Sinklow" card be read. "Geodesic" must roll a 2, 3 or 4 to change back. "Geodesic" then rolls to lead. "Sinklow" is allowed one space for each missed roll.

Sleeper's World

All players must roll 4 or 5, or "Sleeper" may roll a 3, 4 or 5 to leave and lead the way out. If "Sleeper" rolls a 5 on his first try, all players advance eleven (11) spaces and disregard any obstacles within the eleven space move. "Sinklow" is allowed two spaces regardless.

Junkyard/Ship

"Offshoots" must stop here and investigate strange alien spaceship. Follow directions of cards. "Hoop" rolls to lead the way out.

Polluted Lake

Water must be purified before heroes may leave, "Laptop" must roll a 5 in three tries, otherwise "Sinklow" moves five spaces. "Laptop" rolls to lead.

City Park

"Geodesic" is challenged to a skateboard race with an alien visitor capable of great speed. "Geodesic" must roll a 4 in three tries to win. "Sinklow" moves two spaces for each miss. If the match is lost, the "Offshoots" may only move one space after rolling the dice. This allows "Sinklow" to move another three spaces. "Geodesic" then rolls again to lead the way out.

Attack Squares

1) Upon landing on one of these spaces the "Offshoots" are attacked by "Sinklow's" "Phantom Soldiers". A combination roll of 1 and 6 from two players defeats two of the soldiers. The number on each attack square represents the number of "Phantom Soldiers" that attack.
2) "Hoop" and "Changin" must roll together—2 tries
3) "Geodesic" and "Sleeper" must roll together—2 tries
4) "Laptop" and "Changin" must roll together—2 tries "Sinklow" is allowed one space for each double roll. "Changin" rolls to lead the way out.

Question House

The heroes must stop here and read a card, then follow its instructions. "Laptop" and "Hoop" must roll a 4 in three tries to leave. "Sinklow" is allowed three spaces regardless.

Danger Door

"Offshoots" must stop at the dimensional entrance to "Sinklow"'s castle/ship. "Sleeper" must roll a 5 in two tries for the others to enter, if unsuccessful, "Sleeper" is eliminated from the game. If, however, "Changin" tries afterward (rolls a 5 in two tries) and is successful, "Sleeper" is brought back into the game. (Note: "Sleeper" nor "Changin" need not attempt this action, they may elect to turn back and find another route to the castle/ship.)

Hero-Crusher

The "Offshoots" must roll a 5 or 6 in two tries, or "Hoop" may roll a 4, 5 or 6, but if unsuccessful is eliminated from the game. The other "Offshoots" may still defeat Hero-Crusher if they roll a 5 or 6 ("Offshoots" are allowed one more try after "Hoop"'s elimination). "Hoop" is brought back into the game if Hero-Crusher is defeated.

Raspers

The heroes must roll a 5 or 6 in two tries to defeat the semi-gaseous creatures, or "Geodesic" may roll a 4, 5 or 6 in two tries. "Geodesic" is eliminated from the game if unsuccessful. "Sinklow" is allowed two spaces if he has not already occupied his castle/ship, Dread. (NOTE: Before attempting to attack the castle and only after defeating the Raspers, the remaining "Offshoots" have a chance of bringing back eliminated players. A combined roll of 14 in one try.)

Starship

"Sinklow"'s mysterious starship castle is also capable of dimensional travel. The "Offshoots" must destroy it before "Sinklow" arrives to occupy it. "Sinklow"'s added power makes the castle more difficult to destroy. The heroes must roll simultaneously in three tries, three 6's destroys half the structure if unoccupied. "Sinklow" moves two spaces after each miss, if he enters the castle/ship before it is completely destroyed, it becomes a whole structure once again. A combined roll of three 6's and a 4 must then be attained to destroy the structure and end the game. The "Offshoots" have four chances, unless of course they received an 'Extra Roll' card, or the game is ended.

NOTE: Once the attack on the castle is started, Hero-Crusher is revived and occupies the same space as before, he moves three spaces for each attempt by the "Offshoots" to destroy the castle. If the castle is not destroyed, the "Offshoots" are destroyed by Hero-Crusher and the game is ended.

SPECIAL NOTE: If "Sleeper" rolls a 2 or 3 during two of his attempts it may be substituted as a 6, due in part to his special ability.

Owl's Lair

Good omen cards

CARDS

Question House

1) Where is Hunlen Falls—All players roll 4, 5 or produce card
2) Where is Stone Mountain—"Sleeper" and "Hoop" roll 3, 4 or produce card
3) Where is Tors of Dartmoor—"Geodesic" and "Changin" roll 4, 6 or produce card
4) Where is Berlenga Island—"Laptop" roll 1, 2, 5 or produce card
5) Where is Badlands—"Laptop" roll 1, 2, 5, or produce card
6) Visit the Owl
7) Visit the Owl
8) Go back four spaces
9) Go back three spaces
10) Visit Space ship in "Junkyard/Ship" situation space
11) "Sinklow" go back 6 spaces Visit the Owl 1) Hunlen Falls is in Canada
2) Stone Mountain is in Georgia
3) Berlenga Island is in Portugal
4) Badlands is in S. Dakota
5) "Offshoots" receive extra roll when attacking castle
6) "Offshoots" receive life potion
7) "Offshoots" receive life potion
8) "Sinklow" go back seven spaces "Sinklow"

1) Go back 3 spaces
2) Go back 3 spaces
3) "Sinklow" moves three spaces
4) "Sinklow" moves two spaces
5) "Sinklow" moves two spaces
6) Go to City Park
7) Go to "Junkyard/Ship" situation space
8) Go to 2nd Time Door
9) Visit the Owl
10) Visit the owl
11) Go back two spaces
12) Go to Basketball court
13) Go to Polluted Lake Junkyard/Ship 1) Visit the Owl
2) Fight Phantom Soldiers—4
3) "Laptop" receives extra roll next three turns
4) Fight Phantom Soldiers—4
5) Visit the Owl 6) "Sinklow" go back 6 spaces Game Preserve 1) Capture escaped Rhino—"Sleeper" rolls 1, 2 or 3
2) Capture escaped Kangaroos—"Hoop" rolls 1, 3 or 4
3) Capture escaped Skunk—"Changin" rolls 1, 2 or 5
4) Feed the Zebra—all must roll 3, 4 or 5
5) Groom Baboons—"Laptop" rolls 2, 3 or 4
6) Return Panda from "Junkyard/Ship"—"-Geodesic" rolls 2, 3 or 4
7) Return Camels from Polluted Lake—"Sleeper" rolls 2, 3 or 5
8) Visit the Owl
9) Capture Flying Snake of Java—"Hoop" rolls 2, 3 or 4
10) Tors of Dartmoor located in United Kingdom

PLAYERS

Hero Players (Offshoots)

1) "Changin"—female—has ability to assume other forms, but power is limited, loves the latest fashions.
2) "Geodesic"—female—able to find shortest route between two points—skateboard champ
3) "Hoop"—living basketball, can deflate or expand to a finite size
4) "Laptop"—male—powerful computer arm, has martial arts abilities as well
5) "Sleeper"—male—able to enter the dream world and navigate its streams, has other unknown powers while there As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A futuristic board game for allowing players to unite against and attempt to defeat an alien dimensional traveler comprising, in combination:

a story page and rule book combination with the story page providing a fictional backdrop and the rule book providing rules of play;

twenty two game pieces including a group of five hero game pieces and seventeen villain game pieces, the hero game pieces identified as Offshoots with each hero game piece in the group identified as Changin, Geodesic, Hoop, Laptop and Sleeper and with Changin representing a female who has the ability to assume other forms and who loves fashions, Geodesic representing a female who is able to find the shortest route between two points, Hoop representing a living basketball that can deflate and expand to a finite Size, Laptop representing a male who has a powerful computer arm and possesses martial arts abilities, and Sleeper representing a male who is able to enter and navigate a dream world, and with each hero game piece further representing a player, the villain game pieces including four Rasper game pieces representing semi-gaseous creatures, one Hero-crusher game piece representing an entity who can revive during a course of a game if previously destroyed, ten Phantom Soldier game pieces representing soldiers, one Sinklow game piece representing an alien dimensional traveler, and one Starship Castle game piece representing the home of the Sinklow game piece, and with the Rasper, Hero-Crusher, and Phantom Soldier game pieces serving as minions to the Sinklow game piece;

an essentially rectangular and planar game board bearing a starting space depicted as a basketball goal positioned at an upper left corner of the game board and representing an initiation of a journey for each player, a Playground situation space depicted as a basketball court positioned on an upper left quadrant of the game board, a plurality of Time Door situation spaces depicted as a pair of parallel dashed lines positioned on a central portion of the game board, a Game Preserve situation space depicted as a rectangular box with letters GP located therein and positioned on a central upper extent of the game board, a Sleeper's World situation space depicted as an enclosed curve with word SLEEPER WORLD located therein and positioned on an upper right quadrant of the game board, a Junkyard/Ship situation space depicted as a spaceship and positioned on the central extent of the game board, a Polluted Lake situation space depicted as a lake and positioned in the upper left quadrant of the game board, a City Park situation space depicted as a plurality of trees and positioned within the central extent of the game board, a plurality of Attack situation spaces each depicted with a 5 or a 6 and positioned within a lower central extent and a lower right quadrant of the game board, a Question House situation space depicted as a house and positioned within a central extent of the game board, a Danger Door situation space depicted as a set of doors and positioned within the lower right quadrant of the game board, an Owl's Lair situation space depicted as a nest within a tree and positioned within the lower left quadrant of the game board, a Hero-Crusher situation space depicted as a silhouette of a caped man and positioned within the lower central extent of the game board, a Starship situation space depicted as a triangle and positioned within a lower right corner of the game board and representing a conclusion of the journey for each player, and a plurality of rectangular blank traveling spaces interconnected between the situation spaces, and wherein movement and actions of a hero game piece upon reaching a situation space is set forth by the rules of play within the story page and rule book combination;

five dice each having a box shape with six faces, the faces of each die bearing dotted indicia from 1 to 6 respectively and with the dice rollable for controlling movement of the game pieces upon the game board; and forty-eight playing cards separated into five stacks with the first stack having thirteen Sinklow cards and with each Sinklow card supplying an instruction to move one of the game pieces to another space on the game board, the second stack having eleven Question House cards and with each Question House card posing a geographical-type question or supplying an instruction to move one of the game pieces to another space on the game board, the third stack having ten Game Preserve cards and with each Game Preserve card supplying an instruction to roll the dice or an instruction to move one of the game pieces to another space on the game board or a geographical fact, the fourth stack having eight Visit the Owl cards and with each Visit the Owl card supplying a geographical fact, and the fifth stack having six Junkyard/Ship cards and with each Junkyard/Ship card supplying an instruction to move one of the game pieces to another space on the game board or directing that one of the players receives extra rolls of the dice or commanding that one of the players fights some of the villains.

* * * * *